US008414298B2

(12) United States Patent
D'Souza et al.

(10) Patent No.: US 8,414,298 B2
(45) Date of Patent: Apr. 9, 2013

(54) SNIPER TRAINING SYSTEM

(75) Inventors: Clifford Clark D'Souza, National City, CA (US); Allen E. Ripingill, Jr., Turners Falls, MA (US)

(73) Assignee: Cubic Corporation, San Diego, CA (US)

( * ) Notice: Subject to any disclaimer, the term of this patent is extended or adjusted under 35 U.S.C. 154(b) by 1338 days.

(21) Appl. No.: 12/136,701

(22) Filed: Jun. 10, 2008

(65) Prior Publication Data

US 2012/0178053 A1 Jul. 12, 2012

Related U.S. Application Data

(60) Provisional application No. 61/036,408, filed on Mar. 13, 2008.

(51) Int. Cl.
*F41G 3/26* (2006.01)

(52) U.S. Cl. ..... 434/19; 434/22

(58) Field of Classification Search ..... 434/11–27; 702/158; 42/126, 142
See application file for complete search history.

(56) References Cited

U.S. PATENT DOCUMENTS

| | | | | |
|---|---|---|---|---|
| 3,882,496 | A | 5/1975 | Lewis et al. | |
| 6,549,872 | B2 * | 4/2003 | Bollweg et al. | 702/158 |
| 8,091,268 | B2 * | 1/2012 | York | 42/142 |
| 2004/0088898 | A1 | 5/2004 | Barrett | |
| 2007/0234626 | A1 * | 10/2007 | Murdock et al. | 42/126 |

FOREIGN PATENT DOCUMENTS

EP 0100719 A 2/1984

* cited by examiner

*Primary Examiner* — Timothy A Musselman
(74) *Attorney, Agent, or Firm* — Kilpatrick Townsend & Stockton LLP

(57) ABSTRACT

A method and system for a projectile training system that automatically predicts a ballistics solution based upon automatically-gathered meteorological and distance information is disclosed. The projectile training system also confirms that manual efforts performed by an operator to adjust the sight turrets would or would not result in a hit and/or kill of the target. Both adjustment of the turrets and aim of weapon is automatically gathered in a determination of whether there was a hit, kill, miss, or near miss. A light or other signal is sent from the weapon toward the target to indicate a shot was sent by the weapon.

17 Claims, 5 Drawing Sheets

SNIPER TRAINING SYSTEM

This application claims the benefit of and is a non-provisional of co-pending U.S. Provisional Application Ser. No. 61/036,408 filed on Mar. 13, 2008, which is hereby expressly incorporated by reference in its entirety for all purposes.

BACKGROUND

This disclosure relates in general to weapons systems and, but not by way of limitation, to projectile aiming systems.

Sniper, law enforcement officers, hunters, and gunners are trained using live ammunition. Excluding basic marksmanship training, military and law enforcement agencies used specialized training equipment to simulate live fire during training exercises. This equipment provides training participants a means to safely simulate a live fire event during training so that hits and kills can be recorded. Some of the systems also facilitate a mutual exchange of simulated gunfire between shooter and target so that individual and collective skills can be evaluated.

The basic training systems use a laser transmitter to simulate live fire. The laser transmitter is mounted to the small arms weapon or weapon platform, and co-aligned to its sighting mechanism or fire control system. The laser transmitter sends a coded message to targets fitted with an infrared detector. If the transmitter is pointed directly at the target when the laser transmitter is triggered, then the beam of infrared light is detected by the target and registered as a kill, hit, miss, or near miss.

Although these systems work well in most training environments, they have neither technical capability nor ballistic fidelity to provide sufficient training to evaluate basic sniper and gunnery skills. Snipers and gunners are not only required to hold a steady aim while sighting their targets, they're also bound by necessity to follow advanced marksmanship techniques; estimate range, estimate atmospheric conditions, estimate target posture; calculate a firing solution; and correctly adjust sights and accurately lead moving targets.

Projectiles that travel over long distances through various atmospheric conditions ultimately drift off course from their original trajectory. The visual point of aim is, as a rule, slightly different from the actual point of impact of a projectile. A weapon sight can be properly adjusted to match the expected point of impact. If the weapon's sighting mechanism is properly adjusted, and the weapon has been properly stabilized, the projectile should impact very close to the point of aim.

Long range interdiction techniques have been well established to increase the likelihood of acquiring, engaging, and hitting distant targets. To ensue that projectiles hit their intended targets, shooters and observers make observations to gather information about their targets posture and position, and to estimate atmospheric conditions. This data is inserted into a ballistic formula to compute a firing solution. Necessary adjustments are made to the weapon sights or fire control system. The shifted point of aim is intended to pair up with the estimated point of impact. On ground weapon platforms the gunner establishes may establish a "hold" for static targets or "lead" for moving targets. These techniques permit shooters to hit their intended targets with a high degree of accuracy.

But training with live ammunition is costly, dangerous, and also limits marksmanship training to engaging inanimate targets; most targets are dynamic not static, for example, humans, vehicles, and animals.

SUMMARY

In one embodiment of the invention, a projectile training system automatically predicts a ballistics solution based upon automatically-gathered meteorological and distance information is disclosed. The projectile training system also confirms that manual efforts performed by an operator to adjust the sight turrets would or would not result in a hit and/or kill of the target. Both adjustment of the turrets and aim of weapon is automatically gathered in a determination of whether there was a hit, kill, miss, or near miss. A light signal is sent from the weapon toward the target to indicate a shot was sent by the weapon.

In an embodiment, the projectile training system measures range to target, captures atmospheric data, calculates a ballistic solution, and transmit information between shooter and target, determines a realistic projectile point of impact, to confirm the hit. The projectile training system verifies if shooter correctly employed marksmanship techniques and procedures, to accurately engage long range targets by resolving the visual aim point of a weapon or weapon platform to compensate for range, atmospheric conditions, and target posture during live, virtual, and virtually constructed training exercises.

Embodiments of the projectile training system evaluate a shooter's ability estimate range, atmospheric conditions, and target data, ability to calculate a firing solution, to cooperatively confirm hits on targets fitted with infrared detectors. This projectile training system provides individual and collective training capabilities that realistically evaluate a shooter's long range marksmanship. The projectile training system provides the shooter with higher fidelity of training, with light-weight, low-cost hardware for indoor and outdoor training using real world tactics, techniques, and procedures in one embodiment. The projectile training system simulates the adjusted aim point to replicate a realistic point of impact of a simulated projectile to accurately record target hits and misses.

In one embodiment, a sniper training system for analyzing weapon aim is disclosed. The sniper training system includes a projectile simulation weapon, a target, a weather station, a ballistic processor, and a module. The projectile simulation weapon configured to emit a light beam when activated. The projectile simulation weapon includes at least one turret sensor to measure manual adjustment to a turret knob. The target is configured to detect the light beam. The weather sensor is configured to gather meteorological information. The ballistic processor determines a ballistic solution based, at least in part, on the meteorological information and a distance between the target and the projectile simulation weapon. The module is configured to determine if a hit has occurred after receipt of the light beam, wherein the manual adjustment is compared to the ballistic solution in determining if the hit would have occurred.

In yet another embodiment, a method for weapon aim testing between a projectile simulation weapon and a target is disclosed. In one step, current meteorological information is electronically received. A distance between the projectile simulation weapon and the target is determined. A ballistic solution accounting for the meteorological information and the distance is also determined. Input from an operator is received that indicates aim adjustments to one or more turret knobs. An electronic indication that the projectile simulation weapon has been activated is "fired." After the firing, it is determined if a simulated aim of the projectile simulation weapon relative to the target was on target. It is determined if the aim adjustments properly implement the ballistic solution.

In still another embodiment, a method for weapon aim testing between a projectile simulation weapon and a target is disclosed. An electronic indication that the projectile simulation weapon has been activated is received. Aim adjustments made to one or more turret knobs associated with the projectile simulation weapon are retrieved. A ballistic solution is determined based, at least in part, on meteorological information and a distance between the target and the projectile simulation weapon. It is further determined if the aim adjustments correspond to the ballistic solution sufficiently. A determination is made as to whether the target would have been hit or missed with activation of the projectile simulation weapon.

In yet another embodiment, a sniper training system for analyzing weapon aim between a projectile simulation weapon and a target is disclosed. The sniper training system includes a processor configured to perform several operations. An electronic indication that the projectile simulation weapon has been activated is received along with aim adjustments made to one or more turret knobs of the projectile simulation weapon. A ballistic solution is retrieved that was determined, at least in part, on meteorological information and a distance between the target and the projectile simulation weapon. It is determined if the aim adjustments implemented the ballistic solution sufficiently. It is further determined if the target would have been hit or missed with activation of the projectile simulation weapon.

Further areas of applicability of the present disclosure will become apparent from the detailed description provided hereinafter. It should be understood that the detailed description and specific examples, while indicating various embodiments, are intended for purposes of illustration only and are not intended to necessarily limit the scope of the disclosure.

BRIEF DESCRIPTION OF THE DRAWINGS

The present disclosure is described in conjunction with the appended figures.

In the appended figures, similar components and/or features may have the same reference label. Further, various components of the same type may be distinguished by following the reference label by a dash and a second label that distinguishes among the similar components. If only the first reference label is used in the specification, the description is applicable to any one of the similar components having the same first reference label irrespective of the second reference label.

DETAILED DESCRIPTION

The ensuing description provides preferred exemplary embodiment(s) only, and is not intended to limit the scope, applicability or configuration of the disclosure. Rather, the ensuing description of the preferred exemplary embodiment (s) will provide those skilled in the art with an enabling description for implementing a preferred exemplary embodiment. It being understood that various changes may be made in the function and arrangement of elements without departing from the spirit and scope as set forth in the appended claims.

Figure 1A:
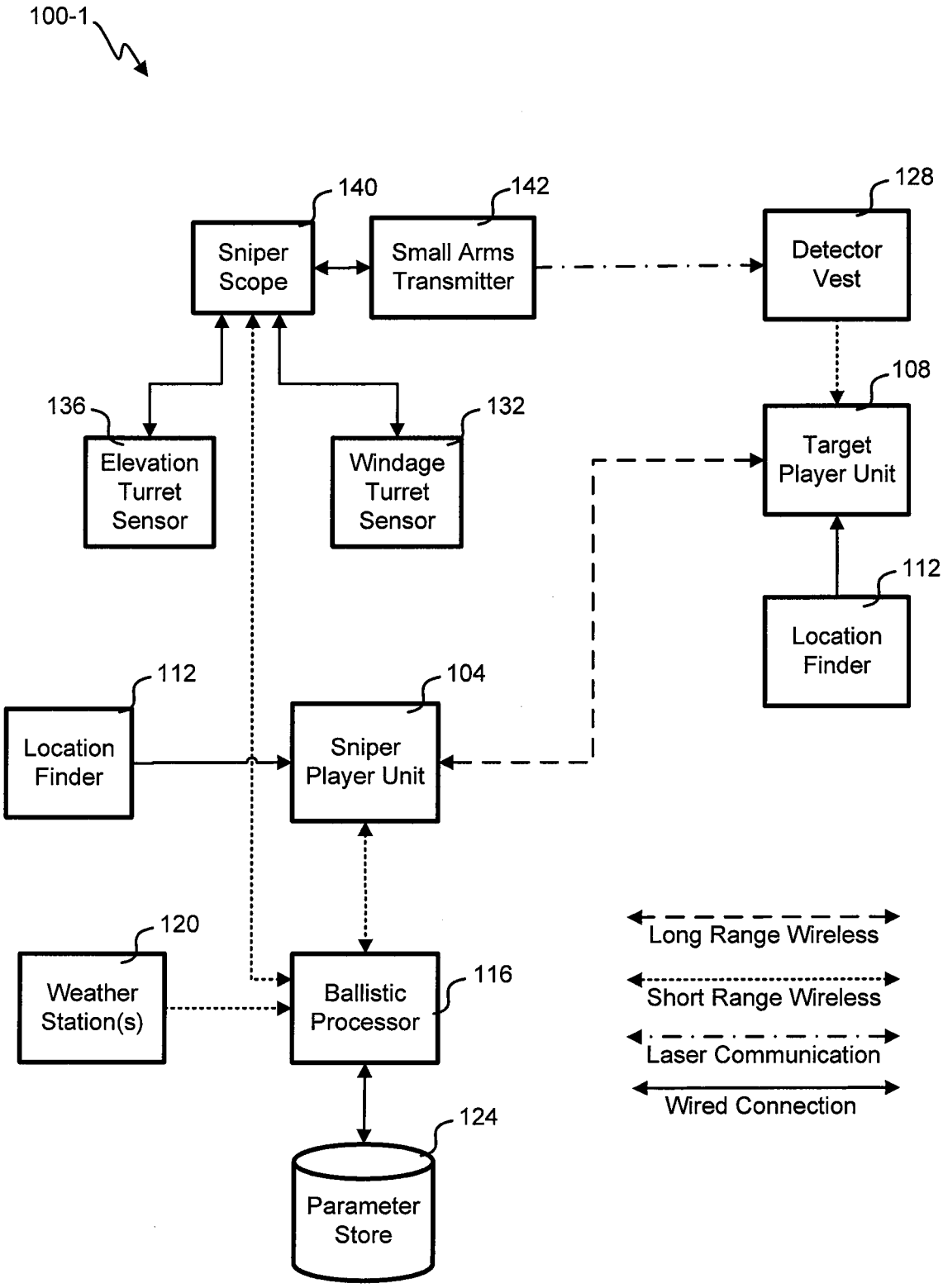
FIGS. 1A through 1C depict block diagrams of embodiments of a sniper training system.

Referring first to FIG. 1A, a block diagram of an embodiment of a sniper training system 100-1 is shown. This embodiment uses a combination of wired, various wireless and optical communications to distribute information throughout the system 100-1. Other embodiments could use a different combination of these communication media to pass information between the various blocks. Mounted with the rifle or weapon in this embodiment are a sniper scope 140, a small arms transmitter (SAT) 142, and azimuth and elevation turret sensors 132, 136 with their knob overlays. A sniper player unit 104 is coupled to a location finder 112 (e.g., global positioning system, local trilateration system, etc.) along with other blocks of the system 100-1. A ballistics processor 116 has a parameter store 124 and is wirelessly coupled to one or more weather stations 120.

This embodiment uses the sniper scope 140 to aim the weapon at a target down range. The sniper scope 140 is mounted to the weapon to allow aiming adjustment training. The SAT 142 is aligned with the point of aim, and the sniper scope is aligned with the SAT 142. Adjustment recorded by the azimuth and elevation turret sensors 132, 136 does not change the alignment of anything, but indicates how the sniper or operator is adjusting the azimuth and elevation turret sensors 132, 136. Measuring these adjustments allows determining if the sniper has done adjustments properly. Turret knobs generally allow changing the aim of the weapon relative to the sniper scope 140, but the turret sensors 132, 136 have knobs that overlay the turret knobs to prevent changing the aim while recording those adjustments.

Through an eyepiece, the sniper can view a magnified image of the target. Graduated cross-hairs overlay the magnified image to aid in compensating for windage drift and elevation drop. A wireless transceiver allows the sniper scope 140, the turret sensors 132, 136, sniper player unit 104 and weather stations 120 to communicate with the ballistic processor 116. Various embodiments of the sniper scope 140 could include a digital compass, an inclinometer, a thermometer, a barometer, a location finder or interface to one, an integral sniper player unit, and/or an integral ballistics processor.

Turret knobs that are normally used to adjust the aim of the weapon relative to the sniper scope 140 are disabled in the sniper training system 100. A projectile is susceptible to atmospherics and gravity as it travels to the target, but the SAT 142 is generally unaffected. The sniper scope 140 should aim in the same direction as the weapon. Adjustment of the turret knobs disrupts this alignment so turret sensor knobs overlay the turret knobs to prevent their normal operation.

In the training system, the sniper or operator is determining adjustments to the turret knobs by analysis of various meteorological and trajectory information. Some of this information may be automatically gathered in some embodiments, for example, the weather station(s) may display the readings of wind speed and barometric pressure. Generally, the sniper uses tools that may be used in the field of combat. Whatever tools are used, corrections are entered to the azimuth and elevation knobs, but in this case, the sniper instead adjusts the turret sensors 132, 136 that can be later checked against a calculation by the ballistic processor 116.

The turret sensor knobs record the sniper's adjustments with turret sensors 132, 136. For example, the turret sensor knobs could be hollow to overlay the turret knobs such that when the turret sensor knobs are turned, the turret knobs were unaffected. How the sniper adjusts the turret sensor knobs is relayed to the ballistic processor and recorded. The turret sensors 132, 136 could be wired to the sniper scope 140 and use the wireless transceiver in the sniper scope 140 as an alternative way to communicate with the ballistic processor 116.

The ballistic processor 116 determines how the elevation and azimuth knobs would normally be adjusted in a live fire situation to successfully hit the target. The azimuth or windage knob mechanically moves the sniper scope 140 in a horizontal plane, and the elevation knob mechanically moves the sniper scope 140 in a vertical plane. The turret sensor knobs disable the normal operation of the azimuth and elevation knobs as correction of the weapon aim with respect to the sniper scope is unnecessary for a SAT 142, which is generally unaffected by atmospherics and gravity. When shooting laser light from the SAT 142 to the detector vest 128, the laser light goes in-line with the point of aim for the weapon regardless of any atmospherics or vertical drop of the round.

To determine a ballistic solution (i.e., adjustment recommendations to the azimuth and elevation knobs), the ballistic processor 116 uses distance to target, firing round parameters, weapon specifications, any movement of the target, and/or meteorological conditions. Location finders 112 at the sniper and target locations allow determining distance to the target in addition to the direction the weapon should be aimed to reach the target. Other embodiments could use laser or other types of range finding, for example, using the SAT 142 to determine the distance between the weapon and the target.

The ballistic processor 116 could be embodied in a computer, personal digital assistant, radio, cell phone, player unit, sniper scope or any other computing device. An interface to the ballistic processor 116 allows manual entry of various parameters such as firing round parameters and weapon specifications. This information could be automatically determined by gathering that information from the SAT, which is configured to simulate a particular round and weapon.

The ballistic processor 116 additionally gathers meteorological condition information from one or more weather stations 120. The weather station 120 determines wind speed and direction, temperature, barometric pressure, and humidity. Additionally, the position of the weather station 120 relative to the sniper location can be determined. Between the sniper and target, there may be differing meteorological conditions. Multiple weather stations can be used by the ballistic processor 116 to model the varying conditions between the weapon and the target. The weather station 120 and sniper scope 140 and other equipment proximate to the ballistic processor 116 can communicate with a short-range wireless mechanism such as Bluetooth™ or Zigbee™.

The various parameters used by the ballistic processor 116 are stored in a parameter store 124. A storage medium is used to implement the parameter store 124 that could be integral, removable or separate from the computing device of the ballistic processor 116. The ballistic solution along with the readings from the elevation and azimuth turret sensors 136, 132 can be recorded over time. Through communication with the sniper player unit 104, information in the parameter store 124 can be shared using a combat network radio (or other long range wireless media) with the other player units.

In this embodiment, the various components are used in a training system 100. Over a combat radio network, the various player units 104, 108 can communicate with each other to determine hits, misses, near misses, or kills, for example, a multiple integrated laser engagement system (MILES) 2000 could be used. The SAT 142 is attached to the weapon and activated by a sensor on the triggering mechanism or a sensor that is triggered by vibration or a flash. Some embodiments of weapons in training systems produce a vibration and/or flash when the weapon is fired to more closely simulate a live fire situation.

In one embodiment, the SAT 142 is secured into the barrel of the weapon. During configuration, the SAT 142 is linked to a particular sniper player unit 104. Data and identification codes can be communicated by the SAT 142 to the detector vest 128 and/or other components in a training system 100. This embodiment of the SAT 142 is triggered by a vibration sensor that determines the weapon has been "fired." The SAT 142 sends a unique code with free-space laser communication. Each SAT 142 is associated with a particular sniper player unit 104 such that the target player unit 108 can determine the sniper player unit 104 that was responsible for any SAT signal it receives.

This embodiment can determine the distance between the sniper player unit 104 and the target player unit 108 using the two location finders 112. In other embodiments, the SAT 142 is capable of laser range finding to determine this distance. However found, the determined range can be communicated to the ballistic processor 116 to aid in determining the ballistic solution.

When a detector vest 128 receives a laser signal from a SAT 142, the laser signal can be analyzed to determine identifier of the SAT 142 associated with the weapon that "fired" the laser signal. The sniper player unit 104 associated with each SAT 142 is known by each target player unit 108 such that correct sniper player unit 104 can be looked-up and queried. The detector vest 128 has optical sensors distributed around such that a laser signal is likely to be read by at least one optical sensor when the laser signal is shot from the SAT 142. In a given training system 100, there maybe optical sensors on equipment, transports and structures to record incoming laser signals from various SATs 142. The target player unit 108 has a location finder 112 coupled to it. The location of the target player unit 108 is sent to the sniper player unit 104 associated with the SAT 142. In this way, the sniper player unit 104 can determine the distance to a target if ranging mechanisms are not used in a particular embodiment.

In this embodiment, the sniper training system 100 determines after a weapon is shot if there should be a successful hit, kill, miss, or near miss. In this embodiment, the target player unit 108 queries the sniper player unit 104 who makes the determination if the target was hit, killed, missed, or nearly missed. More specifically, the target player unit 108 communicates using the combat radio network with the sniper player unit 104 to receive an indication if the azimuth and turret sensors recorded adjustments that match the ballistic solution. Where the settings were correct, the target player unit 108 records hit or kill after analysis. A visual indication of the result of the fire is displayed in the sniper scope viewfinder, on a display of the computing device and/or on the detector vest in various embodiment.

Analysis of shots can be performed anywhere in the sniper training system 100 and communicated to the player units 104, 108 involved. In various embodiments, the determination of the accuracy of the shot could be determined centrally, in the target player unit 108 or the sniper player unit 104.

The various blocks in the figures can be integrated in various ways. Some embodiments will put most of the sniper-side blocks in an integrated package mounted to the weapon. Weather stations 120 could be hard-wired to the ballistic processor when nearby, for example, a weather station could be mounted to the weapon. Other weather stations could use a short range wireless media if nearby, but other weather stations could use a long range wireless solution like the combat radio network.

Figure 1B:
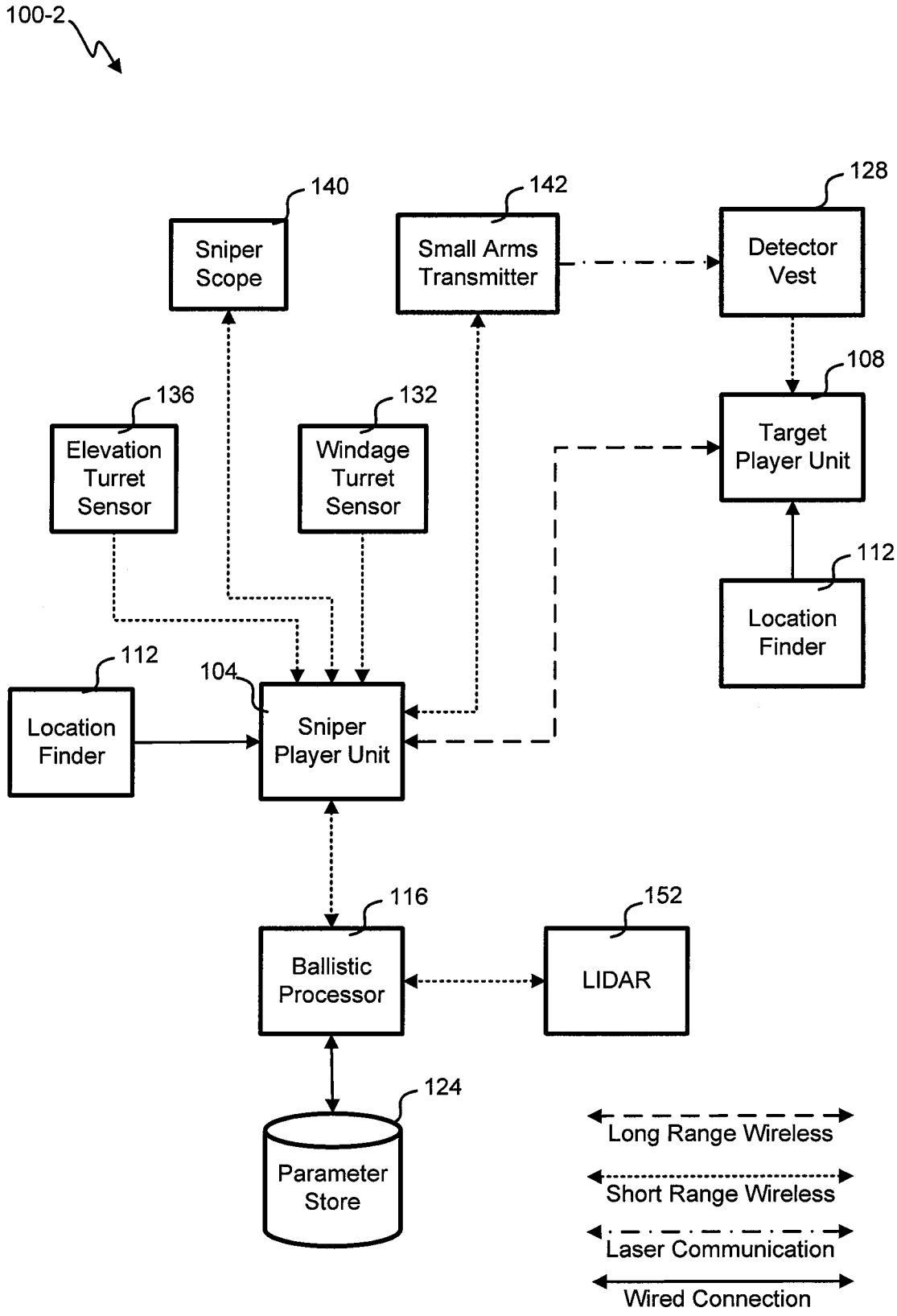

Referring next to FIG. 1B, a block diagram of yet another embodiment of a sniper training system 100-2 is shown that uses laser induced differential absorption radar (LIDAR) 152. The ballistic processor 116 gathers meteorological and ranging information with the LIDAR. LIDAR 152 allows determining distance that the weapon would shoot. Additionally, the LIDAR 152 can be used to determine wind direction along the point of aim and other meteorological information instead of using a weather station(s). This embodiment mounts the LIDAR 152 to the sniper scope 140 and/or weapon to aim the LIDAR 152 in the direction the weapon is aiming. This embodiment uses LIDAR for ranging and gathering of meteorological information.

Figure 1C:
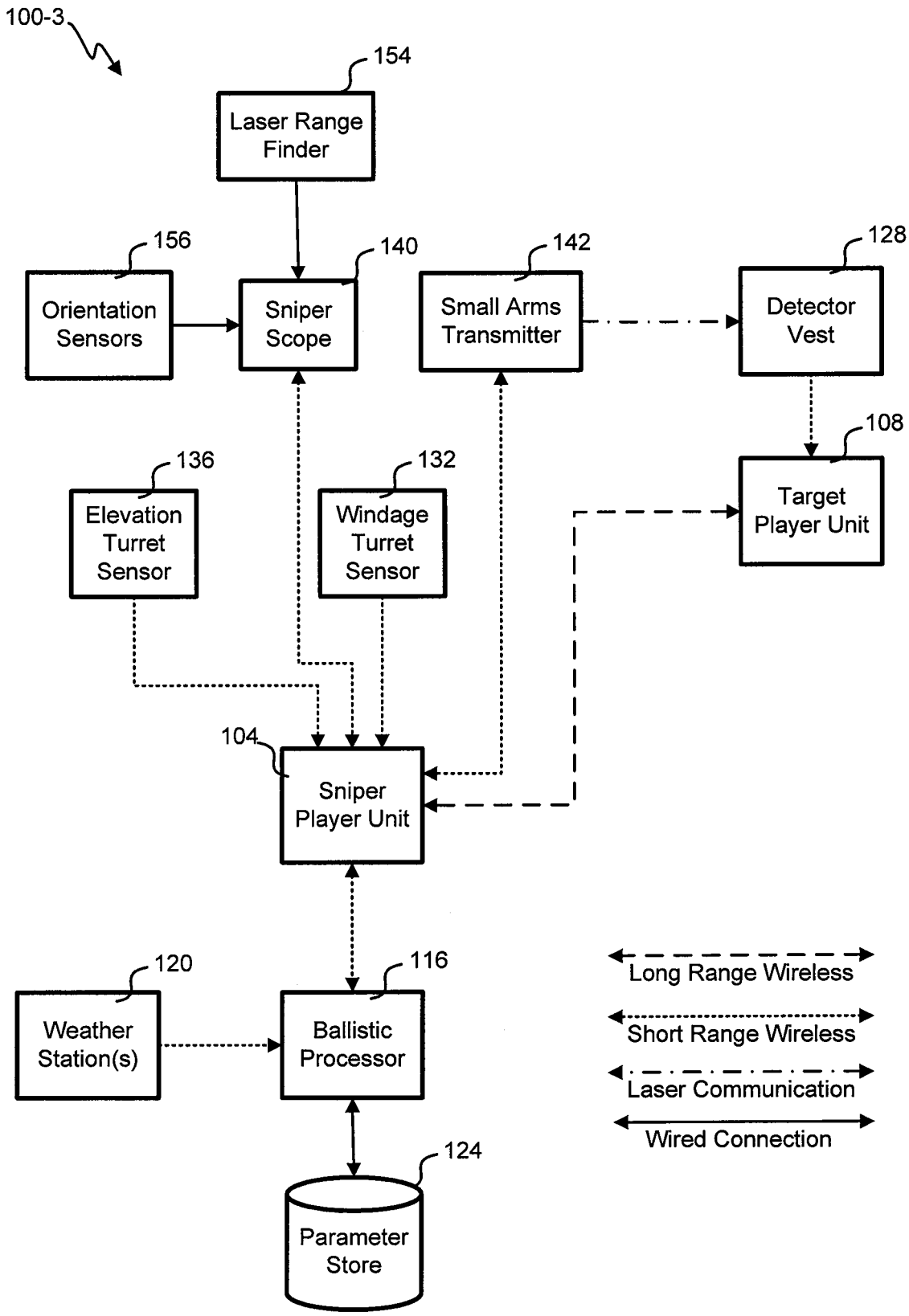

With reference to FIG. 1C, a block diagram of another embodiment of a sniper training system 100-3 is shown that adds laser range finding and orientation sensing capabilities. A laser range finder 154 is mounted to the sniper scope 140 and/or weapon such that the laser range finder 154 is aligned with the point of aim for the weapon. Additionally, orientation sensors 156 are affixed to the sniper scope 140 to gather information used in determining the ballistic solution. The orientation and range readings are coupled to the sniper scope 140 and wirelessly relayed to the sniper player unit 104 and ballistic processor 116. The ballistic processor 116 uses the orientation and range in determining the ballistic solution that is used to check the manual adjustments determined manually by the sniper.

Figure 2:
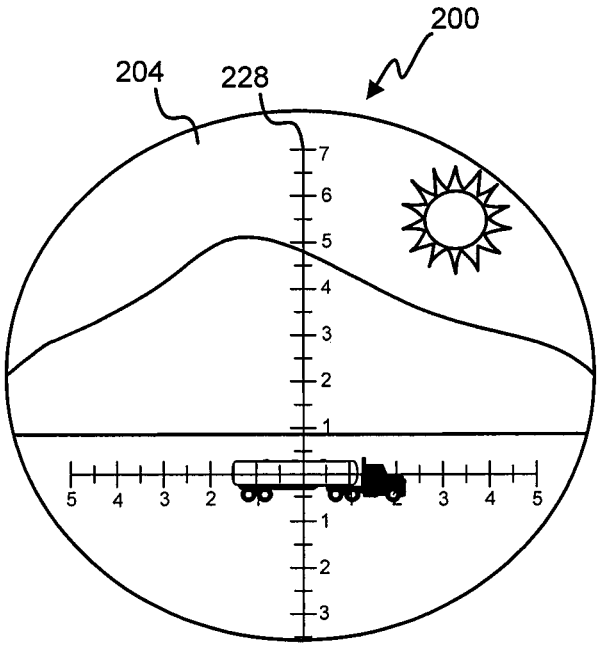
FIG. 2 illustrates a diagram of an embodiment of an image visible through a viewfinder of an sniper scope.

With reference to FIG. 2, a diagram of an embodiment of an image 200 visible through a viewfinder of a sniper scope 140 is shown. Part of the image 200 is dedicated to the target scene 204, which could be directly relayed through optics or could be displayed on a screen for indirect viewing of the target. In this embodiment, the sniper scope 140 uses optics to relay the image 200. The sniper scope 140 could be used for training and/or combat.

The target scene 204 includes the view of the target along with superimposed cross hairs 228. Graduation on the cross hairs correspond to turret adjustment increments. The current elevation setting and azimuth setting read by the turret sensors 132, 136 are overlaid on the target scene 204 in this embodiment. For embodiments with combat identification capability, a friend or foe indicator could be visible through the eyepiece to reflect whether the target was recognized as a friend or not.

Figure 3:
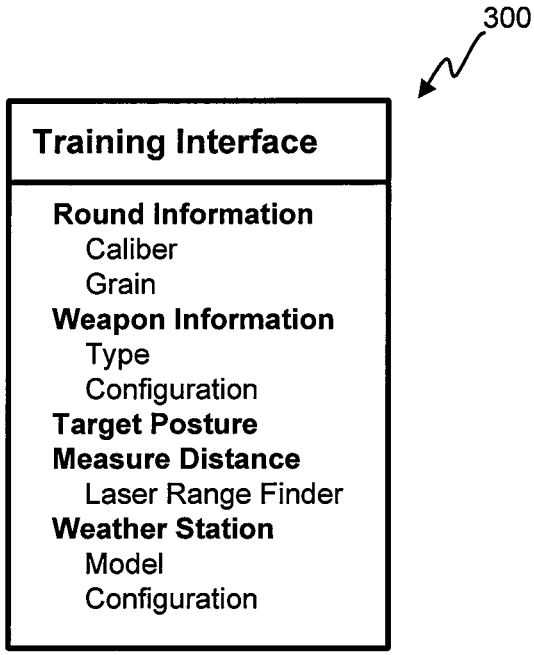
FIG. 3 illustrates a diagram of an embodiment of an interface to a ballistics processor.

Referring next to FIG. 3, an embodiment of an interface 300 to the ballistics processor 116 is shown. The ballistic processor 116 uses manually entered information along with automatically gathered information to formulate a ballistic solution, which is used to determine if the sniper has properly compensated for windage and elevation drop. The software interface can be navigated by the sniper to enter weapon, round information and target posture. Further, the number and type of weather stations can be configured. In some embodiments, some of the automatically gathered information used to find the ballistic solution can be gathered, for example, this embodiment allows the sniper read the range information with the interface 300. An integral or separate keypad on the sniper scope 140 could be used for data entry. On some embodiments, the interface 300 could be part of a handheld computing device that can also serve as the ballistic processor 116.

Figure 4:
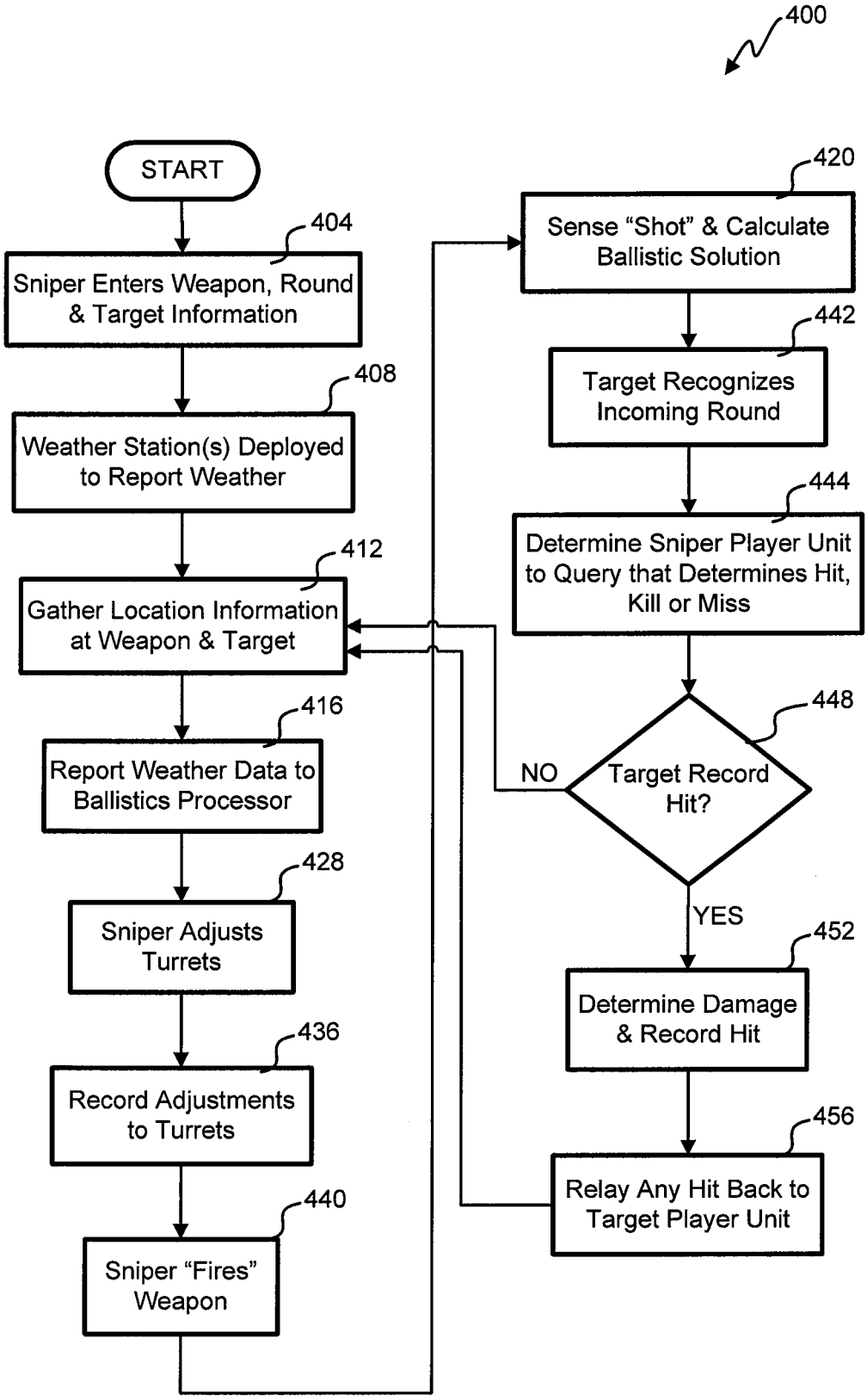
FIG. 4 illustrates a flowchart of an embodiment of a process for sniper training.

Referring next to FIG. 4, a flowchart of an embodiment of a process 400 for sniper training is shown. The depicted portion of the process begins in block 404 where the sniper enters weapon, round information and target posture. One or more weather stations 120 are deployed in block 408 and wire or wirelessly coupled to the rest of the sniper training system 100. Location information and distance to target is automatically gathered in block 412. This can be done with location finders at the sniper and target locations and/or through ranging techniques.

The various weather stations 120 gathering meteorological information report that information periodically to the ballistic processor 116 in block 416. In bock 428, the sniper adjusts the azimuth and elevation sensor knobs according to the ballistic solution. The solution along with the turret sensor 132, 136 readings are stored in the parameter store 124 in block 436 for later determination if a hit, kill, miss, or near miss has occurred.

At some point, the sniper "fires" the weapon in block 440. In a test range, firing the weapon activates the SAT 142 along with an optional vibration or recoil simulator and/or simulated firing noise. A sensor on the trigger or firing pin can be used to determine activation of the weapon in a training situation. Alternatively, a noise or vibration sensor can be used to determine that the weapon has been "shot." After sensing a shot, a ballistic solution is determined in block 420. In block 442, the target player unit 108 recognizes that the sniper has taken a shot at the detector vest 128 by receiving the SAT signal. Embedded in the SAT signal is a unique identifier that can be used by the target player unit 108 to determine the sniper player unit 104 in block 444. The target player unit 108 asks the sniper player unit 104 to determine if the turrets sensors were adjusted in a manner commensurate with the ballistic solution.

A determination is made by the sniper player unit 104 in block 448 to determine if the adjustments made to the azimuth and elevation sensor knobs is close enough match to that required by the ballistic solution to warrant recording a hit, kill, miss, or near miss. The determination can take into the variance that a poorly aimed shot would have based upon the distance along with the yield of the projectile and any other factors. Where it is determined in block 448 that there was a miss or near miss, processing loops back to block 412. A visual indicator can be made to the sniper and/or target when there was a near or total miss.

Where a hit and/or kill is found in block 448, processing continues to block 452 to determine the damage and record the hit. Some embodiments relay this information back to the target player unit 108 in block 456 to indicate to the target the results of the firing. This indication can be used by the target to determine how to proceed in the training exercise before looping back to block 412.

A number of variations and modifications of the disclosed embodiments can also be used. Some embodiments describe use of the current invention with scoped sniper rifles, but other embodiments could use any type of weapon, for example, a rocket launcher, a tank, a canon, a howitzer, a torpedo, a vehicle mounted gun, or any other projectile fired on a battlefield. Civilian weapons that fire a projectile could additionally benefit from this invention. Additionally, some embodiment could be used in combat with live ammunition.

While the principles of the disclosure have been described above in connection with specific apparatuses and methods, it is to be clearly understood that this description is made only by way of example and not as limitation on the scope of the disclosure.

What is claimed is:

1. A sniper training system for analyzing weapon aim, the sniper training system comprising:

a projectile simulation weapon configured to emit a light beam when activated, wherein the projectile simulation weapon includes a scope and at least one turret sensor to measure manual adjustment to a turret knob, wherein the manual adjustment to the turret knob does not adjust the weapon aim relative to the scope;

a target configured to detect the light beam;

a weather sensor configured to gather meteorological information;

a ballistic processor that determines a ballistic solution based, at least in part, on the meteorological information and a distance between the target and the projectile simulation weapon; and a module configured to determine if a hit has occurred after receipt of the light beam, wherein the manual adjustment is compared to the ballistic solution in determining if the hit would have occurred.

2. The sniper training system for analyzing weapon aim as recited in claim 1, wherein the distance is determined with a laser range finder.

3. The sniper training system for analyzing weapon aim as recited in claim 1, further comprising an optical telescope mounted to the projectile simulation weapon, wherein the optical telescope includes the ballistic processor.

4. The sniper training system for analyzing weapon aim as recited in claim 1, wherein the turret knob is manipulated, but sighting of the projectile simulation weapon is unaffected.

5. The sniper training system for analyzing weapon aim as recited in claim 1, wherein the weather station wirelessly communicates the meteorological information.

6. The sniper training system for analyzing weapon aim as recited in claim 1, wherein the distance is determined with the light beam.

7. A method for weapon aim testing between a projectile simulation weapon and a target, the method comprising steps of:

electronically receiving current meteorological information at the ballistic processor;

determining a distance between the projectile simulation weapon and the target;

determining a ballistic solution accounting for the meteorological information and the distance;

recording input from an operator indicating aim adjustments to one or more turret knobs, wherein the adjustments to the one or more turret knobs do not adjust the weapon aim of the projectile simulation weapon relative to a scope of the projectile simulation weapon;

firing an electronic indication that the projectile simulation weapon has been activated;

determining, after the firing, if a simulated aim of the projectile simulation weapon relative to the target was on target; and determining if the aim adjustments properly implement the ballistic solution.

8. The method for weapon aim testing between the projectile simulation weapon and the target as recited in claim 7, wherein the meteorological information is measured away from the projectile simulation weapon.

9. The method for weapon aim testing between the projectile simulation weapon and the target as recited in claim 7, wherein the meteorological information is measured using LIDAR.

10. The method for weapon aim testing between the projectile simulation weapon and the target as recited in claim 7, wherein the one or more turret knobs comprises a azimuth turret knob.

11. The method for weapon aim testing between the projectile simulation weapon and the target as recited in claim 7, wherein the one or more turret knobs comprises an elevation turret knob.

12. The method for weapon aim testing between the projectile simulation weapon and the target as recited in claim 7, wherein the firing step includes a step sending laser light away from the projectile simulation weapon toward the target.

13. The method for weapon aim testing between the projectile simulation weapon and the target as recited in claim 7, wherein the step of determining the distance comprises a step of activating a light detection and ranging sensor to optically determine the distance.

14. The method for weapon aim testing between the projectile simulation weapon and the target as recited in claim 7, wherein the determining the distance step comprises steps of:

automatically determining a first location of the projectile simulation weapon using trilateration; and automatically determining a second location of the target using trilateration.

15. The method for weapon aim testing between the projectile simulation weapon and the target as recited in claim 14, wherein the determining steps are performed in a target player unit.

16. A method for weapon aim testing between a projectile simulation weapon and a target, the method comprising steps of:

receiving an electronic indication that the projectile simulation weapon has been activated;

retrieving aim adjustments made to one or more turret knobs associated with the projectile simulation weapon, wherein the one or more turret knobs are manually adjustable without affecting aim for the projectile simulation weapon relative to a scope of the projectile simulation weapon;

determining a ballistic solution based, at least in part, on meteorological information and a distance between the target and the projectile simulation weapon;

determining if the aim adjustments correspond to the ballistic solution sufficiently; and determining if the target would have been hit or missed with activation of the projectile simulation weapon.

17. A sniper training system for analyzing weapon aim between a projectile simulation weapon and a target, the sniper training system comprising:

a processor configured to:

receive an electronic indication that the projectile simulation weapon has been activated, receive aim adjustments made to one or more turret knobs of the projectile simulation weapon, wherein the aim adjustments do not adjust the aim of the projectile simulation weapon relative to a scope of the projectile simulation weapon;

retrieve a ballistic solution determined, at least in part, on meteorological information and a distance between the target and the projectile simulation weapon, determine if the aim adjustments implemented the ballistic solution sufficiently, and determine if the target would have been hit or missed with activation of the projectile simulation weapon.

* * * * *